US010466002B1

(12) United States Patent
Geissele

(10) Patent No.: US 10,466,002 B1
(45) Date of Patent: Nov. 5, 2019

(54) SAFETY SELECTOR ASSEMBLIES

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/160,026

(22) Filed: Oct. 15, 2018

(51) Int. Cl.
*F41A 17/46* (2006.01)

(52) U.S. Cl.
CPC ..... *F41A 17/46* (2013.01)

(58) Field of Classification Search
CPC ..... F41A 17/64; F41A 17/74; F41A 17/46; F41A 17/56; F41A 35/06
See application file for complete search history.

(56) References Cited

U.S. PATENT DOCUMENTS 2,379,946 A * 7/1945 Baker ..... F41A 17/46 42/70.06
3,292,264 A * 12/1966 Kincannon ..... F41G 11/003 42/124
4,525,932 A * 7/1985 Williams ..... F41G 1/16 42/148
6,174,102 B1 * 1/2001 Do ..... B23Q 1/282 403/381
6,347,538 B1 * 2/2002 Doiron ..... F41A 17/02 42/70.06
8,276,502 B1 * 10/2012 Wright ..... F41A 17/46 42/70.01
8,387,602 B1 * 3/2013 Bruington ..... F41B 7/04 124/20.3
8,549,982 B2 * 10/2013 Troy, Jr. ..... F41A 35/06 89/132
8,806,790 B1 * 8/2014 Huang ..... F41A 17/74 42/70.08
9,003,948 B2 * 4/2015 Brown ..... F41A 19/33 42/70.01
9,518,792 B1 * 12/2016 Huang ..... F41A 35/00
9,541,339 B2 * 1/2017 Orne, III ..... F41A 3/72
9,587,897 B1 * 3/2017 Huang ..... F41A 17/00
9,784,518 B2 10/2017 Geissele
9,829,262 B1 11/2017 Suttie et al.
9,970,726 B1 * 5/2018 Hubert ..... F41A 17/64
9,995,549 B1 * 6/2018 Hamby ..... F41A 19/46
10,126,081 B1 * 11/2018 Geissele ..... F41A 17/46
10,309,741 B2 6/2019 Geissele
2005/0028420 A1 * 2/2005 Rossi ..... F41A 17/74 42/70.08

(Continued)

*Primary Examiner* — Derrick R Morgan
(74) *Attorney, Agent, or Firm* — Fox Rothschild LLP

(57) ABSTRACT

A safety selector assembly for a firearm includes a cylinder sized and shaped to be rotatably received within a lower receiver; and a lever detachably coupled to the cylinder end and secured to the cylinder end by a threaded member. The threaded member is configured to engage the cylinder end, and to move between a first and a second position in relation to the cylinder end. The lever is configured to engage the threaded member when the threaded member is in the first position, and interfering contact between the threaded member and the lever causes the lever to be retained on the cylinder end. The lever can be removed from the cylinder end when the threaded member is in the second position.

20 Claims, 8 Drawing Sheets

(56) References Cited

U.S. PATENT DOCUMENTS

| | | | | |
|---|---|---|---|---|
| 2005/0229462 | A1* | 10/2005 | McGarry | F41A 17/02 42/70.08 |
| 2008/0302235 | A1* | 12/2008 | Lauck | F41A 17/46 89/132 |
| 2012/0325044 | A1 | 12/2012 | Brown | |
| 2013/0111796 | A1* | 5/2013 | Dionne | F41A 17/00 42/70.11 |
| 2013/0152444 | A1* | 6/2013 | Tatum | F41A 17/56 42/70.05 |
| 2014/0259846 | A1* | 9/2014 | Joubert | F41A 17/56 42/70.11 |
| 2016/0018176 | A1 | 1/2016 | Fellows et al. | |
| 2016/0091268 | A1* | 3/2016 | Miller, III | F41A 17/46 42/70.06 |
| 2016/0131449 | A1 | 5/2016 | Horch | |
| 2016/0187092 | A1 | 6/2016 | Mather et al. | |
| 2017/0089655 | A1 | 3/2017 | Geissele | |
| 2017/0122686 | A1 | 5/2017 | Fellows et al. | |
| 2017/0176122 | A1* | 6/2017 | Underwood | F41A 19/46 |
| 2017/0299304 | A1* | 10/2017 | Otte, Jr. | F41A 17/46 |
| 2017/0328663 | A1* | 11/2017 | Fellows | F41A 19/14 |
| 2018/0087859 | A1* | 3/2018 | Underwood | F41A 19/10 |
| 2018/0100712 | A1* | 4/2018 | Tompkins | F41A 3/66 |

* cited by examiner

SAFETY SELECTOR ASSEMBLIES

INTRODUCTION

Firearms are configured to fire rounds of ammunition. To fire a firearm, the user of the firearm can pull a trigger bow of a trigger assembly, which releases a hammer. The hammer is designed to then strike a firing pin which, in turn, strikes an impact sensitive round of ammunition. Once struck, the round of ammunition expels a bullet from the barrel of the firearm toward a target.

In some firearms, the trigger assembly may be selectively placed in one of two modes: a safety mode, in which the trigger assembly cannot be operated; and a fire mode, in which the trigger assembly can be operated to fire the round of ammunition. In other firearms, the trigger assembly may be selectively placed in one of three modes: a safety mode; a semi-automatic fire mode, in which the trigger assembly can be operated to fire a single round with each pull of the trigger; and an automatic fire mode, in which the trigger assembly can be operated to fire a plurality of rounds while the trigger bow is maintained in the pulled position. A safety selector assembly may be provided to operatively engage with the trigger assembly and selectively place the firearm in the various modes as described above. However, to facilitate ease of use of the firearm, the safety selector assembly and/or the safety selector levers of the assembly should be configured for quick and easy installation and/or removal from the firearm.

SUMMARY

The present disclosure relates generally to safety selector assemblies for firearms.

In one aspect, the disclosed technology relates to a safety selector assembly for a firearm, including: a cylinder sized and shaped to be rotatably received within a lower receiver of the firearm, the cylinder including a cylinder end; a lever detachably coupled to the cylinder end and having a first surface that faces the cylinder end when the lever is detachably coupled to the cylinder end; and a threaded member configured to threadably engage the cylinder end and to move between a first and a second position in relation to the cylinder, wherein the lever is configured so that, when the threaded member is in the first position, an end portion of the threaded member contacts the first surface of the lever and the contact between the end portion of the threaded member and the first surface of the lever causes the lever to be retained on the cylinder end. In one embodiment, the lever has a recess formed therein, the recess facing the cylinder end when the lever is detachably coupled to the cylinder end; and the lever is further configured so that, when the threaded member is in the first position, the end portion of the threaded member is positioned within the recess and interfering contact between the end portion of the threaded member and the lever causes the lever to be retained on the cylinder end. In another embodiment, the recess is defined by at least the first surface of the lever, and the lever is configured so that interfering contact between the end portion of the threaded member and the first surface of the lever causes the lever to be retained on the cylinder end when the threaded member is in the first position. In another embodiment, the recess is defined by at least the first surface of the lever, and the threaded member is further configured to contact the first surface of the lever and to urge the first surface of the lever away from the cylinder when the threaded member is in the first position. In another embodiment, the threaded member is a set screw. In another embodiment, the threaded member is configured to threadably engage the cylinder by way of a threaded hole in the cylinder end, and substantially all of the threaded member is disposed in the threaded hole when the threaded member is in the second position. In another embodiment, the lever includes a head portion that includes the first surface, and a post portion extending from the head portion; and the threaded member is configured to urge the head portion against the cylinder end when the threaded member is in the first position.

In another embodiment, the cylinder end has an annular channel formed therein; the head portion defines a cutout and includes a lip adjacent the cutout; the cutout receives as least a portion of the cylinder end; the channel receives the lip; and the threaded member is configured to urge the lip against a surface of the cylinder end adjacent the annular channel when the threaded member is in the first position. In another embodiment, the lever has an opening formed therein and configured to provide access to the threaded member. In another embodiment, the end portion of the threaded member has a keyed recess formed therein, and the opening in the lever is further configured to align with the keyed recess when the lever is detachably coupled to the cylinder end. In another embodiment, the end portion of the threaded member is tapered; and the size and shape of the recess are substantially identical to the respective size and shape of the end portion of the threaded member. In another embodiment, the interfering contact between the threaded member and the lever prevents the lever from moving in a radial direction in relation to an axis of rotation of the cylinder. In another embodiment, the cylinder end is a first cylinder end; the cylinder further includes a second cylinder end; the lever is a first lever; the safety selector assembly further includes a second lever detachably coupled to the second cylinder end and having a first surface; the threaded member is a first threaded member; the safety selector assembly further includes a second threaded member configured to threadably engage the second cylinder end and to move between a first and a second position in relation to the second cylinder end; and the second lever is configured so that, when the second threaded member is in the first position of the second threaded member, an end portion of the second threaded member contacts the first surface of the second lever and the contact between the end portion of the second threaded member and the first surface of the second lever causes the second lever to be retained on the second cylinder end.

In another aspect, the disclosed technology relates to a firearm, including a trigger assembly; a lower receiver configured to house the trigger assembly; and a safety selector assembly rotatably supported at least partially within the lower receiver and operably coupled to the trigger assembly; wherein the safety selector assembly includes: a cylinder sized and shaped to be rotatably received within the lower receiver, the cylinder including a cylinder end; a lever detachably coupled to the cylinder end and having a first surface that faces the cylinder end when the lever is detachably coupled to the cylinder end; and a threaded member configured to threadably engage the cylinder end and to move between a first and a second position in relation to the cylinder, wherein the lever is configured so that, when the threaded member is in the first position, an end portion of the threaded member contacts the first surface of the lever and the contact between the end portion of the threaded member and the first surface of the lever causes the lever to be retained on the cylinder end. In one embodiment, the lever has a recess formed therein, the recess facing the cylinder end when the lever is detachably coupled to the cylinder end; and the lever is further configured so that, when the threaded member is in the first position, the end portion of the threaded member is positioned within the recess and interfering contact between the end portion of the threaded member and the lever causes the lever to be retained on the cylinder end. In another embodiment, the threaded member is configured to threadably engage the cylinder by way of a threaded hole in the cylinder end, and substantially all of the threaded member is disposed in the threaded hole when the threaded member is in the second position. In another embodiment, the recess is defined by at least the first surface of the lever, and the threaded member is further configured to contact the first surface and to urge the first surface away from the cylinder when the threaded member is in the first position.

In another aspect, the disclosed technology relates to a method of assembling a safety selector assembly for a firearm, including: positioning a threaded member in a threaded hole in an end of a cylinder; rotating the threaded member in a first direction to advance the threaded member into the hole until an outwardly-facing end of the threaded member is approximately flush, or recessed in relation to an open end of the hole; inserting a head portion of a lever onto an end of the cylinder by moving the head portion in a radial direction with respect to an axis of rotation of the cylinder so that a first surface of the head portion faces the end of the cylinder; and rotating the threaded member in a second direction to advance an end portion of the threaded member out of the hole and into contact with the first surface of the head portion. In one embodiment, rotating the threaded member in a second direction to advance an end portion of the threaded member out of the hole and into contact with the first surface of the head portion includes rotating the threaded member in the second direction to advance the end portion of the threaded member into a recess in the head portion. In another embodiment, the method further includes: inserting a tool through an opening formed in the head portion and into engagement with a keyed recess in the threaded member, after inserting the head portion of the lever onto the end of the cylinder; and rotating the tool in the second direction while the tool engages the keyed recess.

BRIEF DESCRIPTION OF THE DRAWINGS

The following drawings are illustrative of particular embodiments of the present disclosure and do not limit the scope of the present disclosure. The drawings are not to scale and are intended for use in conjunction with the explanations provided herein. Embodiments of the present disclosure will hereinafter be described in conjunction with the appended drawings.

DETAILED DESCRIPTION

Figure 1:
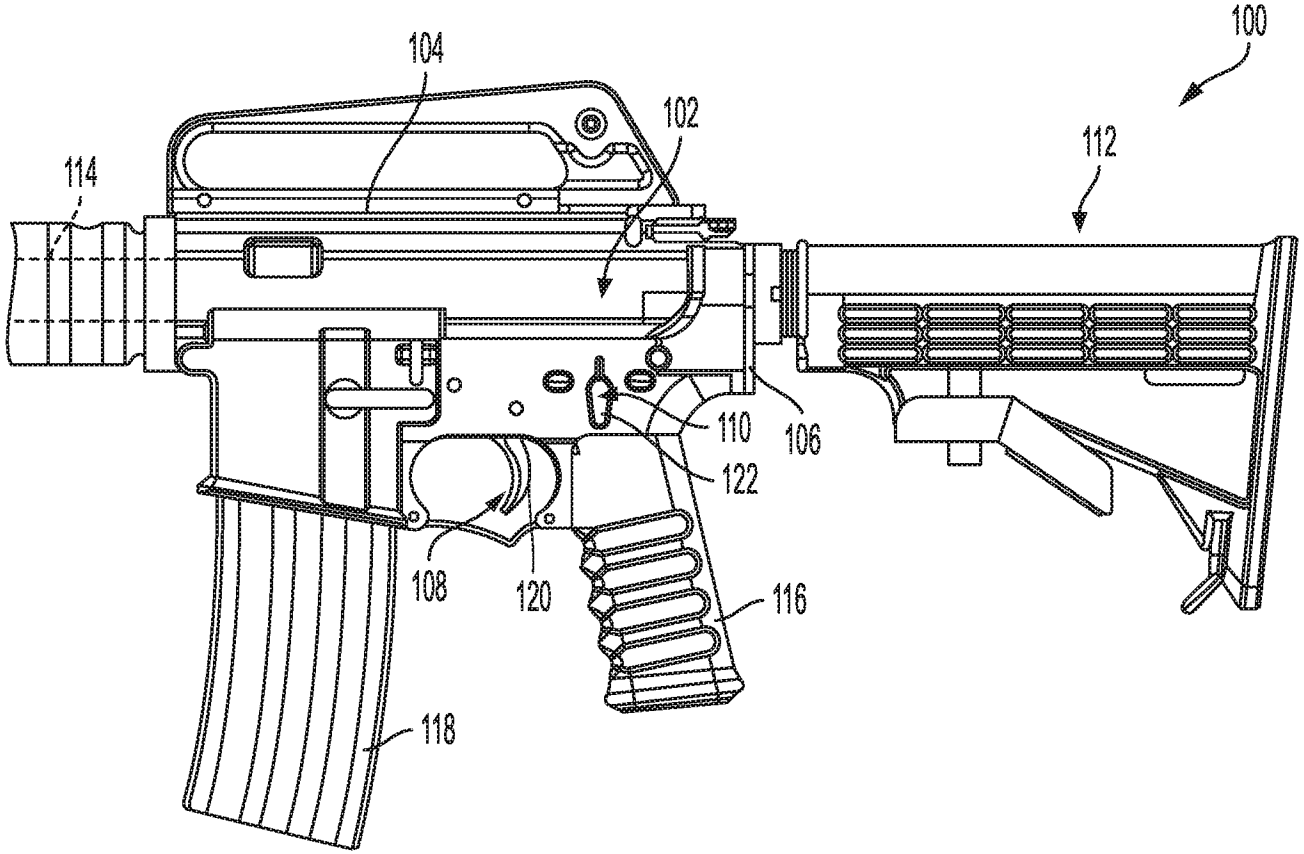
FIG. 1 is a schematic side view of an exemplary firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Exemplary embodiments of a safety selector assembly for use with a firearm are described herein. The safety selector assembly enables the firearm to be switched between different operating modes, and generally includes at least one lever removably attached to a cylinder body. The lever can be secured to the cylinder by a threaded member in the form of a set screw. The set screw is rotatably disposed in a threaded hole in the cylinder. The set screw has an end portion that resides within a recess in the lever when the set screw is partially backed out of the hole. Contact between the end portion of the set screw and the lever prevents the head portion from moving in a radial direction in relation to the axis of rotation of the cylinder, thereby retaining the lever on the cylinder. The set screw can be advanced into its hole so that the end portion no longer is positioned in the recess, at which point the head portion can be moved in a radial direction and removed from the cylinder. The safety selector assembly as described herein thus can be installed and/or removed from the firearm with relative ease, and with minimal time and effort. Additionally, the lever or levers of the safety selector assembly, which form the user interface, can be changed out with relative ease, for example, to accommodate left and right-handed users.

FIG. 1 is a schematic side view of an exemplary firearm 100. In this example, the firearm 100 includes a receiver body 102 formed from an upper receiver 104 and a lower receiver 106, a trigger assembly 108, and a safety selector assembly 110. In some examples, the firearm 100 also may include a stock 112, a barrel 114, a grip 116, and an ammunition magazine 118.

The firearm 100 can be of a variety of types. Examples of the firearm 100 may include, but are not limited to, handguns, rifles, shotguns, carbines, machine guns, submachine guns, personal defense weapons, semi-automatic rifles, and automatic rifles. In at least one example, the firearm is an AR-15, M-16, or M-4 type rifle, or one of their variants.

In the example, the firearm 100 is configured to have a plurality of operating modes. The operating modes may include at least one of a safe mode and a fire mode. When the firearm 100 is in the safe mode, the firearm 100 is prevented from discharging a round of ammunition, while when the firearm 100 is in the fire mode, the firearm 100 may be discharged each time the trigger assembly 108 is activated. Other operating modes may also be present. The safety selector assembly 110 can be used to allow the user to switch between the different operating modes.

The receiver body 102 is configured to house a firing mechanism and associated components as found in, for example, rifles and their variants. The firing mechanism includes the trigger assembly 108 that is at least partially housed in the lower receiver 106; and a bolt assembly (not shown) that is slidably disposed in the upper receiver 104 for axially reciprocating recoil movement therein during a firing cycle sequence of the firearm 100. The bolt assembly is operably interfaced with the trigger assembly 108.

The trigger assembly 108 includes a trigger bow 120 configured to be pulled by the finger of the user (e.g., the index finger) to initiate the firing cycle sequence of the firearm 100. In some examples, the trigger assembly 108 may be configured to provide a plurality of modes enabling different operation of the trigger assembly 108. One example of a multi-mode trigger assembly is described in U.S. Pat. No. 9,618,289, the disclosure of which is hereby incorporated by reference in its entirety.

The safety selector assembly 110 is rotatably coupled to and supported within the lower receiver 106, and is configured to facilitate the switching of the firearm 100 between different operating modes. As mentioned above, each operating mode alters the behavior of the firearm 100. In at least one example, the safety selector assembly 110 includes a first lever 122 that enables the user to switch the safety selector assembly 110 between multiple positions, such as a fire mode position and a safe mode position. The safety selector assembly 110 is operably coupled to the trigger assembly 108 such that upon the positioning of the first lever 122, the trigger assembly 108 has a corresponding operating condition. In the example, the first lever 122 may be disposed on the side of the lower receiver 106.

The stock 112 is configured to be positioned at the rearward portion of the firearm 100 and opposite the barrel 114. The stock 112 provides an additional surface for a user to support the firearm 100 with, such as against the user's shoulder. In some examples, the stock 112 includes a mount for a sling. In other examples, the stock 112 may be a telescoping stock. In yet other examples, the stock 112 may be foldable. In still other examples, the stock 112 may be removably mounted to the receiver body 102, such as by a threaded connection or a removable fastener connection.

The barrel 114 is positioned at the forward end of the firearm 100 and is configured to be installed onto the receiver body 102. The barrel 114 provides a path to release an explosion gas and propel a projectile therethrough. In some examples, the barrel 114 is at least partially surrounded by an accessory assembly that may include a rail system (not shown) for mounting accessories (e.g., a fore-grip, a flashlight, a laser, optic equipment, etc.) thereto. Only a portion of the barrel 114 is illustrated in FIG. 1.

The grip 116 provides a point of support for the user of the firearm 100, and can be held by the user's hand, including when operating the trigger assembly 108 and/or the safety selector assembly 110. The grip 116 can assist the user in stabilizing the firearm 100 during firing and manipulation of the firearm 100. In the example, the grip 116 is mounted to the lower receiver 106.

The ammunition magazine 118 is an ammunition storage and feeding device within the firearm 100. In some examples, the ammunition magazine 118 is detachably installed on the firearm 100. For example, the ammunition magazine 118 is removably inserted into a magazine well of the lower receiver 106 of the firearm 100.

Other examples of the firearm 100 may have configurations and/or components other than those of the examples illustrated and described with reference to FIG. 1. For example, in alternative examples, some of the components listed above are not included.

Figure 2:
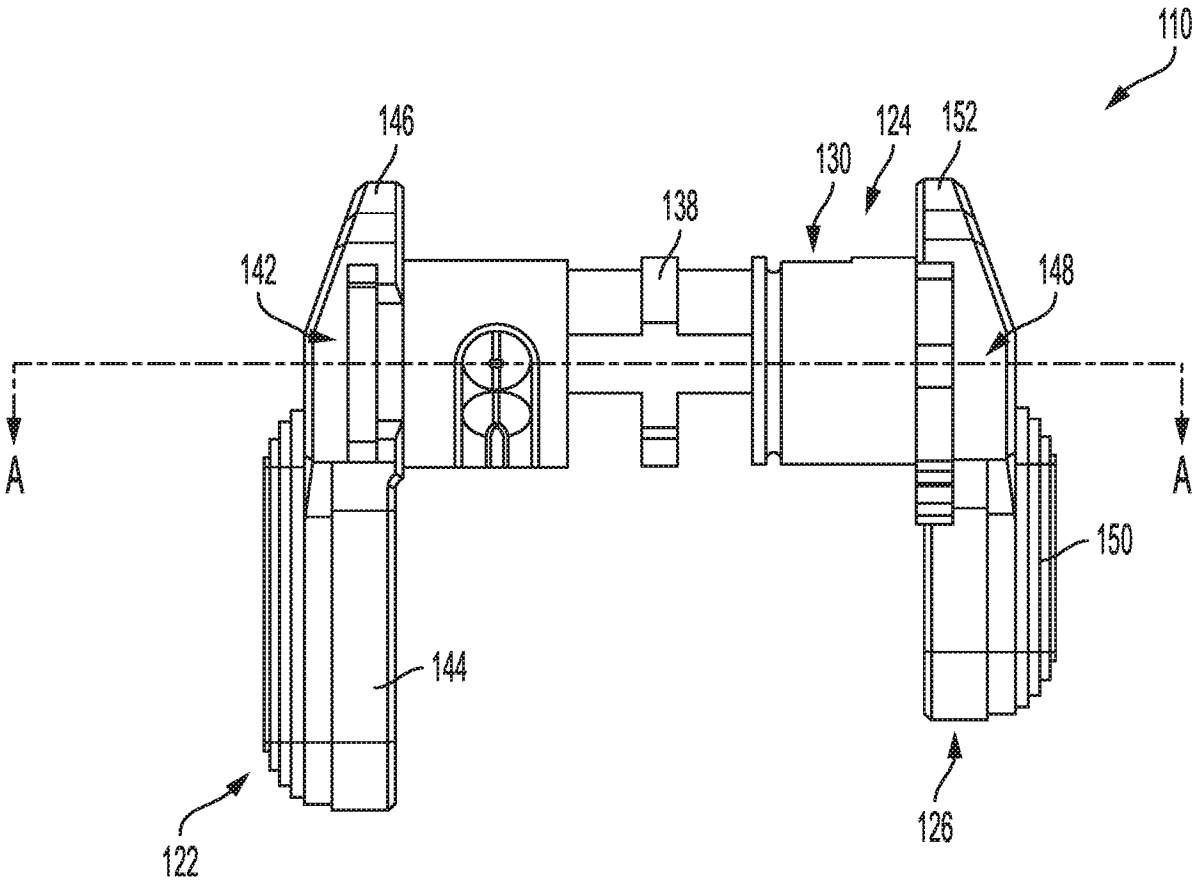
FIG. 2 is a top view of an exemplary safety selector assembly of the firearm shown in FIG. 1, according to one embodiment of the present disclosure.
Figure 3:
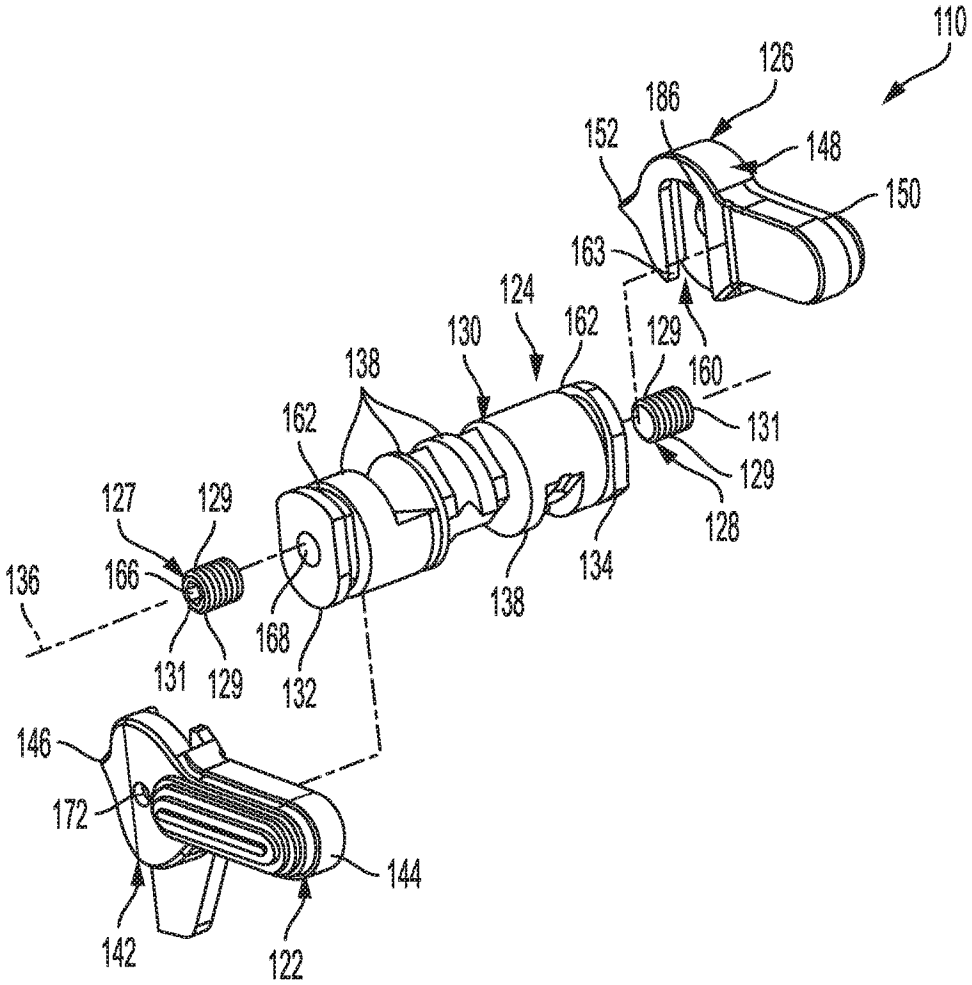
FIG. 3 is an exploded perspective view of the safety selector assembly shown in FIG. 2.
Figure 4:
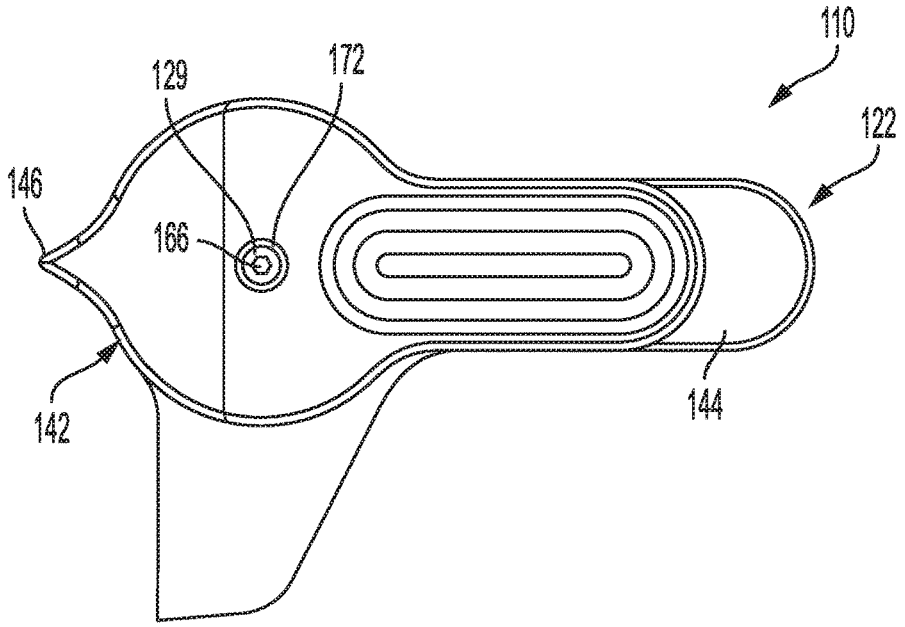
FIG. 4 is a side view of the safety selector assembly shown in FIGS. 2 and 3.
Figure 5:
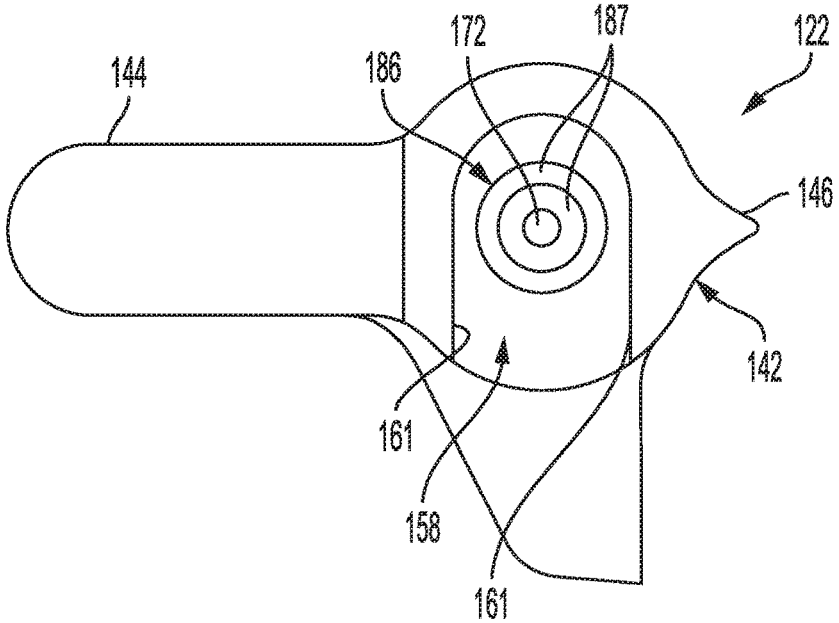
FIG. 5 is a side view of a lever of the safety selector assembly shown in FIGS. 2-4, from a reverse perspective of FIG. 4.
Figure 6:
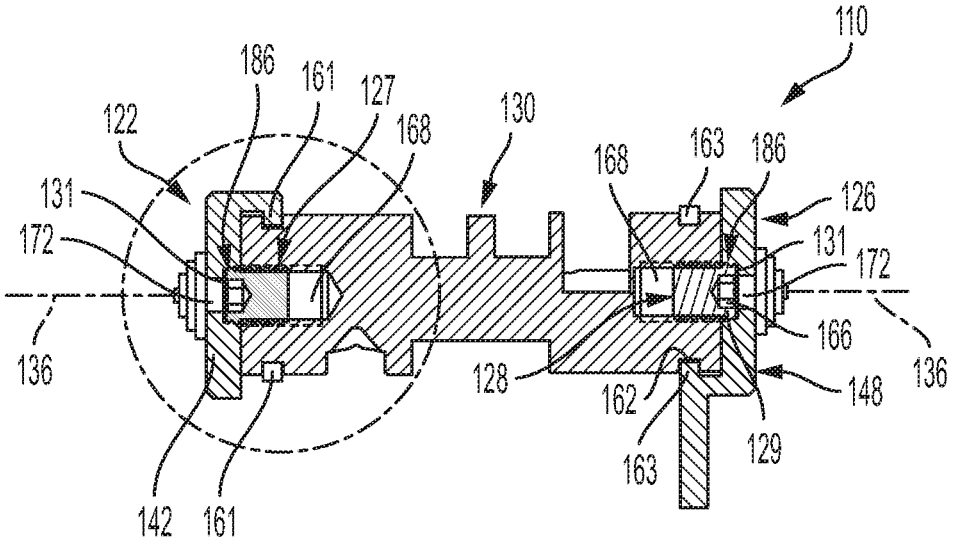
FIG. 6 is a cross-sectional view of the safety selector assembly shown in FIGS. 2-5, taken along the line A-A in FIG. 2.

FIG. 2 is a top view of the safety selector assembly 110 of the firearm 100 shown in FIG. 1. FIG. 3 is an exploded perspective view of the safety selector assembly 110. FIG. 4 is a side view of the safety selector assembly 110. FIG. 5 is a side view of a lever 122 of the safety selector assembly 110. FIG. 6 is a cross-sectional view taken through the line "A-A" of FIG. 2. Referring generally to FIGS. 2-6, the safety selector assembly 110 includes a cylinder 124, a first lever 122, and a second lever 126. The first and second levers 122, 126 may be detachably coupled to the cylinder 124 by threaded members in the form of a first and a second set screw 127, 128, respectively. The ability to remove the first and second levers 122, 126 from the cylinder 124 with relative ease allows the safety selector assembly 110 to be quickly and easily installed and/or removed from the lower receiver 106. Other types of threaded members, such as socket head capscrews, can be used in lieu of the first and a second set screws 127, 128 in alternative embodiments.

The cylinder 124 is sized and shaped to be rotatably received within the lower receiver 106. The cylinder 124 is generally a cylindrical body 130 extending between a first cylinder end 132 and a second cylinder end 134, along a rotational axis 136. In the example, the cylinder body 130 may have one or more stopper portions 138 defined on an outer surface of the body 130. The stopper portions 138 are configured to selectively engage the trigger assembly 108 (shown in FIG. 1) so as to facilitate the switching of the firearm 100 between different operating modes as described above. One example of the configuration of a stopper portion is described in U.S. Pat. No. 9,618,289, the disclosure of which is hereby incorporated by reference in its entirety.

The first lever 122 is removably attached to the first end 132 of the cylinder 124; and the second lever 126 is removably attached to the second end 134 of the cylinder 124. The first and second levers 122, 126 enable the cylinder 124 to be selectively rotated between different operating modes when mounted on the lower receiver 106 and engaged with the trigger assembly 108. As shown in FIG. 1, the first and second levers 122, 126 are exposed along opposite sides of the lower receiver 106, so that a user may rotate either of the first and second levers 122, 126 to change the position of the safety selector assembly 110 and thereby switch the firearm 100 between its different operating modes. In alternative examples, the safety selector assembly 110 may include only a single lever, so that the safety selector assembly 110 is accessible from only one side of the lower receiver 106.

The first lever 122 includes a head portion 142, and a post portion 144 that extends from the head portion 142. The head portion 142 may also include a mode indicator 146 that can be used to indicate, on the lower receiver 106, the operating mode of the trigger assembly 108. The second lever 126 likewise includes a head portion 148 having mode indicator 152; and a post portion 150 that extends from the head portion 148. The post portions 144, 150 enable the user to manually rotate the cylinder 124 from the exterior of the lower receiver 106, to switch the operating mode of the firearm 100.

In the disclosed example, the length of the post portion 144 of the first lever 122 is greater than the length of the post portion 150 of the second lever 126. Different lever shapes and sizes may be used in the alternative, to facilitate a more efficient operation by a particular user. Additionally, the shapes and positions of the first and second levers 122, 126 may be varied to facilitate a more efficient left and/or right hand operation by the user. As such, selectively configuring the first and second levers 122, 126 enables the safety selector assembly 110 to be desirably operable for both left and right handed users. The safety selector assembly 110 enables a quick change of the lever configuration, so that different desired levers may be changed out, and/or an opposite handed user can easily be accommodated with the same cylinder 124. In alternative examples, the first lever 122 may be similarly sized and shaped to the second lever 126. In other alternative examples, the length of the post portion 144 of the first lever 122 can be less than the length of the post portion 150 of the second lever 126.

Figure 7:
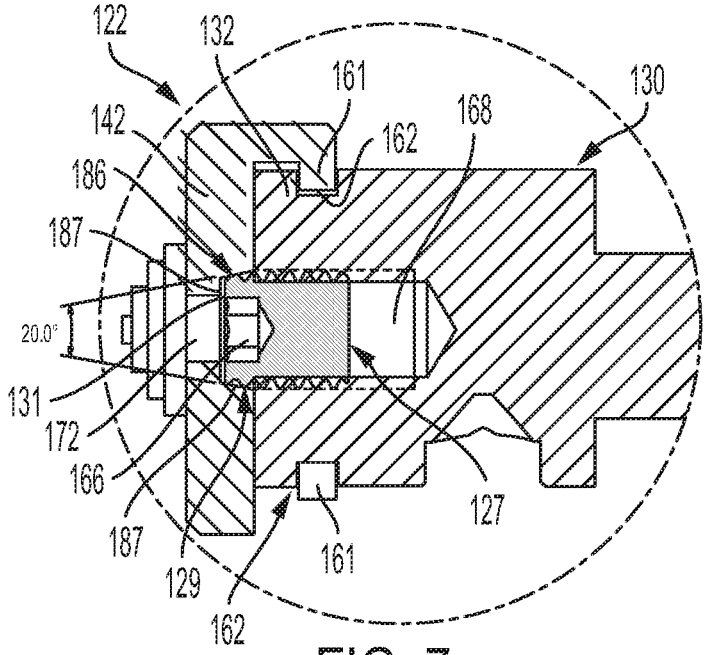
FIG. 7 is a magnified view of the area designated "B" in FIG. 6.

As can be seen in FIG. 5, the head portion 142 of the first lever 122 has a cutout 158 defined therein that permits the first lever 122 to slidably engage the first end 132 of the cylinder 124. Referring to FIG. 3, the head portion 148 of the second lever 126 likewise has a cutout 160 defined therein that permits the second lever 126 to slidably engage the second end 134 of the cylinder 124. The cutouts 158, 160 are sized and shaped to correspond to the respective first and second ends 132, 134 of the cylinder 124, so that a portion of the cylinder 124 is received within each of the cutouts 158, 160. The cylinder 124 may include a plurality of annular channels 162 defined within the cylinder body 130 and positioned adjacent to, and offset from the first and second ends 132, 134. As can be seen in FIGS. 6 and 7, the annular channel 162 associated with the first cylinder end 132 slidably receives a lip 161 formed on the head portion 142 of the first lever 122, adjacent to the cutout 158. The annular channel 162 associated with the second end 134 likewise slidably receives a lip 163 formed on the head portion 148 of the second lever 126, adjacent to the cutout 160. The annular channels 162 and the lips 161, 163 are sized and shaped to correspond to one another so that the first and second levers 122, 126 cannot be pulled out of or otherwise removed from the cylinder 124 in a direction coinciding with the rotational axis 136.

Other mating configurations for the first and second levers 122, 126 and the cylinder 134 can be used in alternative embodiments. For example, the first and second ends 132, 134 of the cylinder 124 can each have a dovetail shape configured to be received in a corresponding slot formed in the head portions 142, 146 of the respective first and second levers 122, 126.

As can be seen in FIGS. 3 and 6-8, the first and second ends 132, 134 of the cylinder 124 each has a threaded hole 168 formed therein and extending along the rotational axis 136. Each hole 168 is sized and shaped to receive the first or the second set screw 127, 128 so that the first and second set screws 127, 128 threadably engage the cylinder 124. In addition, the first and second set screws 127, 128 engage the respective first and second levers 122, 126 so that the first and second levers 122, 126 cannot be slid off of the first and second ends 132, 134 in a radial direction, with respect to the rotational axis 136, without first being disengaged from the respective first or second set screw 127, 128.

Figure 8:
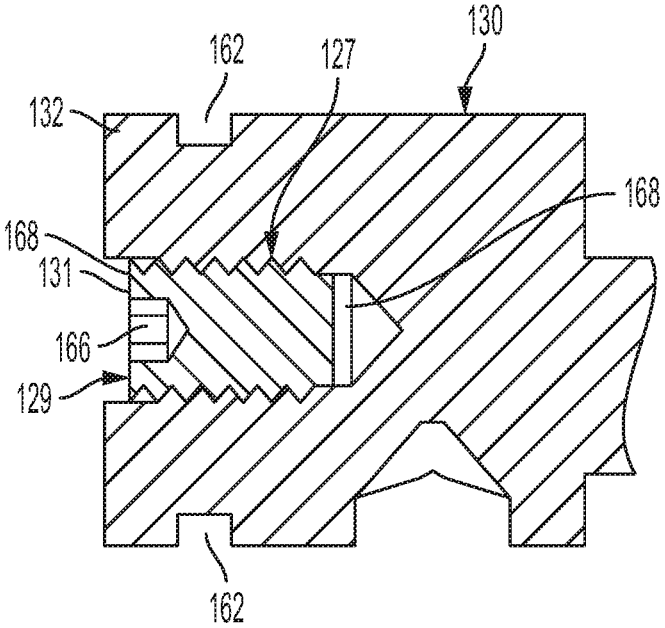
FIG. 8 is a magnified view of the area designated "B" in FIG. 6, depicting a cylinder and a set screw of the safety selector assembly in a condition ready to receive the lever shown in FIG. 5.

To securely couple the first lever 122 to the cylinder 124, the first set screw 127 can be rotated in a clockwise direction, when viewed along the rotational axis 136 looking toward the cylinder 124, to advance the first set screw 127 into the hole 168. The first set screw 127 can be rotated until an outwardly-facing end 131 thereof is approximately flush with, or recessed in relation to the open end of the hole 168 as depicted in FIG. 8, i.e., until all, or nearly all of the first set screw 127 has been retracted into the hole 168. This permits the head portion 142 of the lever 122 to be slid into place on the first end 132 of the cylinder 124. More specifically, the head portion 142 can be positioned so that the lip 161 on the head portion 142 is aligned with the channel 162 associated with the first end 132. The head portion 142 then can be moved radially inward, toward the rotational axis 136, so that the lip 161 slidably engages the first end 132 by way of the channel 162, and the first end 132 becomes disposed within the cutout 158 in the head portion 142, as illustrated in FIGS. 6 and 7.

The directions of rotation for the first and second set screws 127, 128 as specified herein are based on the first and second set screws 127, 128 having a right-handed thread; the first and second set screws 127, 128 can have a left-handed thread in alternative embodiments, in which case the directions of rotation specified herein would be reversed.

Once the head portion 142 has been positioned on the first end 132 of the cylinder 124, the lever 122 can be secured to the cylinder 124 by backing the first set screw 127 out of the hole 168 and into contact with the head portion 142 of the lever 122. This can be accomplished by rotating the first set screw 122 in a counterclockwise direction using an elongated tool (not shown) that engages a keyed recess 166 formed in an end portion 129 of the first set screw 127. The tool 169 can be inserted through an opening 172 that is formed in the head portion 142 and aligns with the keyed recess 166. The recess 166 can be configured, for example, in a standard internal hex pattern, and the tool can be a standard hex key, or Allen wrench; other types of keyed configurations, such as a Torx pattern or a standard screwdriver slot, can be used in the alternative.

As can be seen in FIGS. 5-7, the head portion 142 has a recess 186 formed therein, between the cutout 158 and the opening 172. The recess 186 is defined by internal surfaces 187 of the head portion 142. The recess 186 is not threaded, i.e., the internal surfaces 187 are smooth. The counterclockwise rotation of the first set screw 127 causes the end portion 129 of the first set screw 127 to become disposed within the recess 186.

The end portion 129 of the first set screw 127 is tapered, as shown for example in FIG. 7. The taper angle can be, for example, about 20'; other taper angles can be used in the alternative. In other alternative embodiments, the end portion 129 can be non-tapered, i.e., the outer diameter of the first set screw 127 can be substantially constant along its length. The recess 186 has a taper that substantially matches the taper of the end potion 129, and is dimensioned to substantially match the dimensions of the end portion 129.

The counterclockwise rotation of the first set screw 127 eventually brings the end portion 129 into contact with the internal surfaces 187 of the head portion 142, as shown in FIGS. 6 and 7. Because the recess 186 defined by the internal surfaces 187 has a shape and size that approximately match those of the end portion 129, the end portion 129 engages, and is seated against the surfaces 187. Interfering contact between the end portion 129 and the surfaces 187 prevents the head portion 142 of the first lever 122 from moving radially outward with respect to the rotational axis 136. This prevents the head portion 142 from backing away from the first cylinder end 132, and thereby causes the first lever 122 to be retained on the cylinder 124. Also, the force exerted by the first set screw 127 on the head portion 142 in the axial direction, i.e., along the axis of rotation 136, urges the lip 161 of the head portion 142 firmly against the adjacent surface of the first end 132 of the cylinder 124. The resulting friction between the contacting surfaces of the lip 161 and the first end 132 rotatably couples the first lever 122 to the cylinder 124. Contact between the end portion 129 of the first set screw 127 and the internal surfaces 187 of the head portion 142 also helps to rotatably couple the first lever 122 to the cylinder 124.

The tapered configuration of the end portion 129 of the first set screw 127, and the matching shape and dimensions of the recess 186, maximize the contact area between the first set screw 127 and the head portion 142, and helps to ensure that contact between the end portion 129 and the head portion 142 occurs via machined surfaces. The tapered configuration also helps to center the head portion 142 in relation to the cylinder 124, and locks the first lever 122 in place on the cylinder 124 with additional security. These features help to produce a solid and secure connection between the head portion 142 and the cylinder 124 by securing the first set screw 127 from rotation within its associated hole 168, and by reducing or eliminating relative movement between the first lever 122 and the cylinder 124.

The second lever 126 can be securely coupled to the cylinder 124 in a manner substantially identical to the first lever 122. The second set screw 128 can be rotated in a clockwise direction, to advance the second set screw 128 into its associated hole 168 in the second end 134 of the cylinder 124, until an outwardly-facing end 131 of the second set screw 128 is approximately flush with, or recessed in relation to the open end of the hole 168. This permits the head portion 148 of the second lever 126 to be slid into place on the second end 134. More specifically, the head portion 148 can be positioned so that the lip 163 on the head portion 148 is aligned with the channel 162 associated with the second end 134. The head portion 148 then can be moved radially inward, toward the rotational axis 136, so that the lip 163 slidably engages the second end 134 by way of the channel 162, and the second end 134 becomes disposed within the cutout 160 in the head portion 148.

Once the head portion 148 has been positioned on the second end 134 of the cylinder 124, the second lever 126 can be secured to the cylinder 124 by backing the second set screw 128 out of its associated hole 168 and into contact with the head portion 148 of the second lever 126, as depicted in FIG. 6. This can be accomplished by rotating the second set screw 128 in a counterclockwise direction, using the elongated tool to engage a keyed recess 166 in an end portion 129 of the second set screw 128. The tool 169 can be inserted through an opening 172 formed in the head portion 148 and aligned with the keyed recess 166.

To remove the first lever 122 from the cylinder 124, the first set screw 127 is rotated in the clockwise direction, when viewed along the rotational axis 136, looking toward the cylinder 124, to advance the first set screw 127 into its associated hole 168. The first set screw 127 is rotated using the tool 169, until the outwardly-facing end 131 of the first set screw 127 becomes approximately flush with, or recessed in relation to the open end of hole 168. At this point, the first set screw 127 no longer interferes with the movement of the head portion 142 of the first lever 122 in the radial direction, and the first lever 122 then may be slid off of the cylinder 124 in a radial direction coinciding with the orientation of the cutout 158.

Similarly, to remove the second lever 126 from the cylinder 124, the second set screw 128 is rotated in the clockwise direction until the outwardly-facing end 131 of the second set screw 128 becomes approximately flush with, or recessed in relation to the open end of its associated hole 168, at which point the second set screw 128 no longer interferes with the movement of the head portion 148 of the second lever 126 in the radial direction, allowing the second lever 126 to be slid off the cylinder 124.

The above-described configuration of the safety selector assembly 110 permits the safety selector assembly 110 to be quickly and easily installed and/or removed from the firearm 100. In addition, the ability of the user to easily remove and reinstall the first and second levers 122, 126 using a standard tool facilitates the ready changeout of the first and second levers 122, 126 to accommodate the requirements or preference of the user. Also, the first and second set screws 127, 128 provide a solid and secure connection between the cylinder 124, and first and second levers 122, 126.

Figure 9:
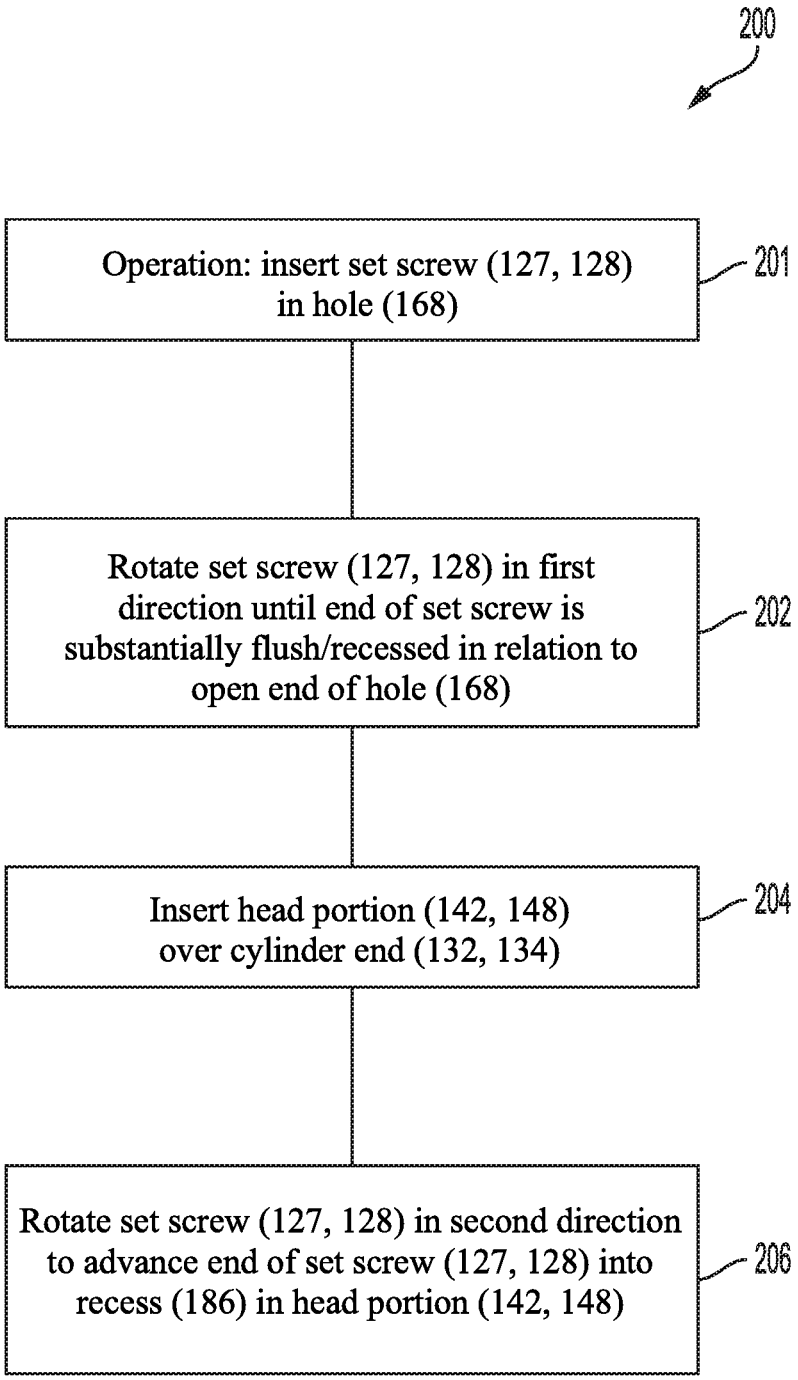
FIG. 9 is a flowchart illustrating an exemplary method of assembling the safety selector assembly shown in FIGS. 1-8.

FIG. 9 is a flowchart illustrating an exemplary method 200 of assembling the safety selector assembly 110. To assemble the safety selector assembly 110, a set screw 127, 128 is inserted into a threaded hole 168 on an end of a cylinder 124 of the safety selector assembly 110 (operation 201). The set screw 127, 128 is then rotated in a first direction to advance the set screw 127, 128 into the hole 168, until an outwardly-facing end 131 of the set screw 127, 128 is approximately flush, or recessed in relation to an open end of the hole 168 (operation 202). A head portion 142, 148 of a lever 122, 126 is then inserted onto the first and second ends (132, 134) of the cylinder 124 by moving the head portion 142, 148 in a radial direction with respect to an axis of rotation 136 of the cylinder 124 (operation 204). The set screw 127, 128 is subsequently rotated in a second direction to advance an end portion 129 of the set screw 127, 128 out of the hole 168, and into a recess 186 in the head portion 142, 148, so that interference between the end portion 129 and the head portion 142, 148 retains the lever 122, 126 on the cylinder 124 (operation 206).

Figure 10:
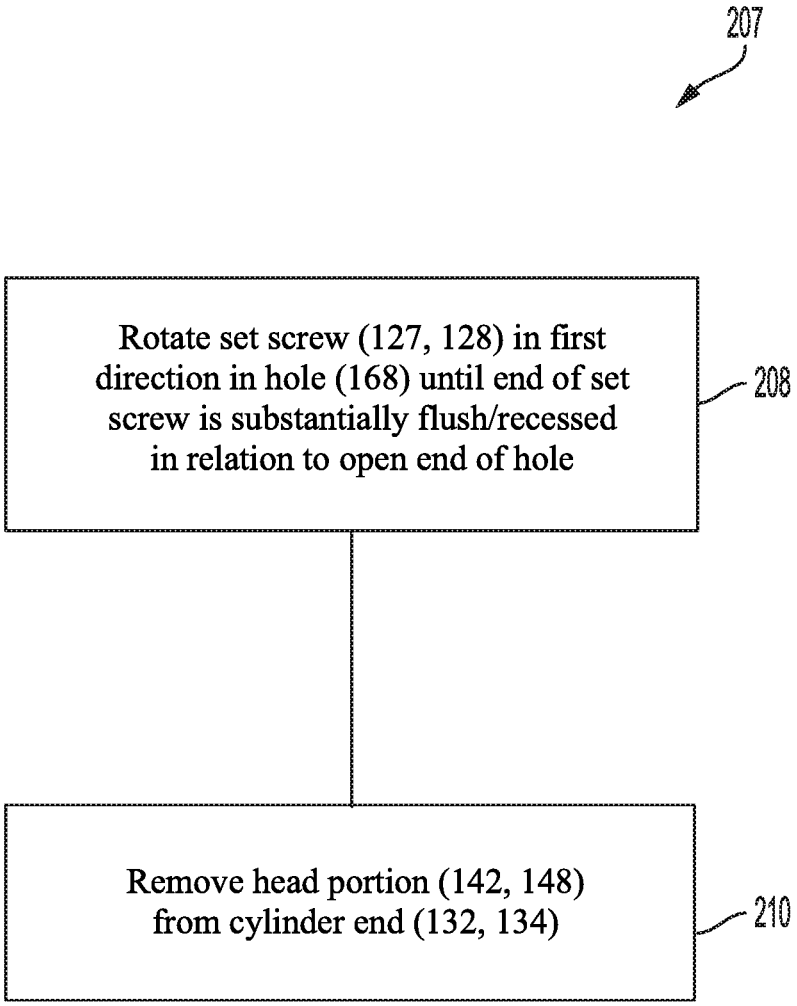
FIG. 10 is a flowchart illustrating an exemplary method of disassembling the safety selector assembly shown in FIGS. 1-8.

FIG. 10 is a flowchart illustrating an exemplary method 207 of assembling the safety selector assembly 110. The set screw 127, 128 is rotated in the first direction to advance the set screw 127, 128 into the hole 168, until an outwardly-facing end 131 of the set screw 127, 128 is approximately flush, or recessed in relation to an open end of the hole 168 (operation 208). The head portion 142, 148 of the lever 122, 126 is then removed from the ends 132, 134 of the cylinder 124, by moving the head portion 142, 148 in a radial direction with respect to the axis of rotation 136 of the cylinder 124 (operation 210).

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims. For example, the first and second levers 122, 126 can be configured without the recesses 186 in alternative embodiments. In such embodiments, retention of the first and second levers 122, 126 on the cylinder 124 in the radial direction can be achieved by virtue of contact between the outwardly-facing ends 131 of the first and second set screws 127, 128 and the adjacent surfaces of the respective head portions 142, 148 of the first and second levers 122, 126; and by virtue of the resulting frictional forces between the head portions 142, 148 and the contacting surfaces of the respective first and second ends 132, 134 of the cylinder 124.

What is claimed is:

1. A safety selector assembly for a firearm, comprising:

a cylinder sized and shaped to be rotatably received within a lower receiver of the firearm, the cylinder comprising a cylinder end;

a lever detachably coupled to the cylinder end and having a first surface that faces the cylinder end when the lever is detachably coupled to the cylinder end; and a threaded member configured to threadably engage the cylinder end and to move between a first and a second position in relation to the cylinder, wherein the lever is configured so that, when the threaded member is in the first position, an end portion of the threaded member contacts the first surface of the lever and the contact between the end portion of the threaded member and the first surface of the lever causes the lever to be retained on the cylinder end.

2. The safety selector assembly of claim 1, wherein:

the lever has a recess formed therein, the recess facing the cylinder end when the lever is detachably coupled to the cylinder end; and the lever is further configured so that, when the threaded member is in the first position, the end portion of the threaded member is positioned within the recess and interfering contact between the end portion of the threaded member and the lever causes the lever to be retained on the cylinder end.

3. The safety selector assembly of claim 2, wherein the recess is defined by at least the first surface of the lever, and the lever is configured so that interfering contact between the end portion of the threaded member and the first surface of the lever causes the lever to be retained on the cylinder end when the threaded member is in the first position.

4. The safety selector assembly of claim 2, wherein the recess is defined by at least the first surface of the lever, and the threaded member is further configured to contact the first surface of the lever and to urge the first surface of the lever away from the cylinder when the threaded member is in the first position.

5. The safety selector assembly of claim 4, wherein the threaded member is a set screw.

6. The safety selector assembly of claim 1, wherein the threaded member is configured to threadably engage the cylinder by way of a threaded hole in the cylinder end, and substantially all of the threaded member is disposed in the threaded hole when the threaded member is in the second position.

7. The safety selector assembly of claim 1, wherein the lever comprises a head portion that includes the first surface, and a post portion extending from the head portion; and the threaded member is configured to urge the head portion against the cylinder end when the threaded member is in the first position.

8. The safety selector assembly of claim 7, wherein:

the cylinder end has an annular channel formed therein;

the head portion defines a cutout and includes a lip adjacent the cutout;

the cutout receives as least a portion of the cylinder end;

the channel receives the lip; and the threaded member is configured to urge the lip against a surface of the cylinder end adjacent the annular channel when the threaded member is in the first position.

9. The safety selector assembly of claim 1, wherein the lever has an opening formed therein and configured to provide access to the threaded member.

10. The safety selector assembly of claim 9, wherein the end portion of the threaded member has a keyed recess formed therein, and the opening in the lever is further configured to align with the keyed recess when the lever is detachably coupled to the cylinder end.

11. The safety selector assembly of claim 2, wherein the end portion of the threaded member is tapered; and the size and shape of the recess are substantially identical to the respective size and shape of the end portion of the threaded member.

12. The safety selector assembly of claim 2, wherein the interfering contact between the threaded member and the lever prevents the lever from moving in a radial direction in relation to an axis of rotation of the cylinder.

13. The safety selector assembly of claim 1, wherein:

the cylinder end is a first cylinder end;

the cylinder further comprises a second cylinder end;

the lever is a first lever;

the safety selector assembly further comprises a second lever detachably coupled to the second cylinder end and having a first surface;

the threaded member is a first threaded member;

the safety selector assembly further comprises a second threaded member configured to threadably engage the second cylinder end and to move between a first and a second position in relation to the second cylinder end; and the second lever is configured so that, when the second threaded member is in the first position of the second threaded member, an end portion of the second threaded member contacts the first surface of the second lever and the contact between the end portion of the second threaded member and the first surface of the second lever causes the second lever to be retained on the second cylinder end.

14. A firearm, comprising a trigger assembly; a lower receiver configured to house the trigger assembly; and a safety selector assembly rotatably supported at least partially within the lower receiver and operably coupled to the trigger assembly; wherein the safety selector assembly comprises:

a cylinder sized and shaped to be rotatably received within the lower receiver, the cylinder comprising a cylinder end;

a lever detachably coupled to the cylinder end and having a first surface that faces the cylinder end when the lever is detachably coupled to the cylinder end; and a threaded member configured to threadably engage the cylinder end and to move between a first and a second position in relation to the cylinder, wherein the lever is configured so that, when the threaded member is in the first position, an end portion of the threaded member contacts the first surface of the lever and the contact between the end portion of the threaded member and the first surface of the lever causes the lever to be retained on the cylinder end.

15. The firearm of claim 14, wherein:

the lever has a recess formed therein, the recess facing the cylinder end when the lever is detachably coupled to the cylinder end; and the lever is further configured so that, when the threaded member is in the first position, the end portion of the threaded member is positioned within the recess and interfering contact between the end portion of the threaded member and the lever causes the lever to be retained on the cylinder end.

16. The firearm of claim 14, wherein the threaded member is configured to threadably engage the cylinder by way of a threaded hole in the cylinder end, and substantially all of the threaded member is disposed in the threaded hole when the threaded member is in the second position.

17. The firearm of claim 15, wherein the recess is defined by at least the first surface of the lever, and the threaded member is further configured to contact the first surface and to urge the first surface away from the cylinder when the threaded member is in the first position.

18. A method of assembling a safety selector assembly for a firearm, comprising:

positioning a threaded member in a threaded hole in an end of a cylinder;

rotating the threaded member in a first direction to advance the threaded member into the hole until an outwardly-facing end of the threaded member is approximately flush, or recessed in relation to an open end of the hole;

inserting a head portion of a lever onto an end of the cylinder by moving the head portion in a radial direction with respect to an axis of rotation of the cylinder so that a first surface of the head portion faces the end of the cylinder; and rotating the threaded member in a second direction to advance an end portion of the threaded member out of the hole and into contact with the first surface of the head portion.

19. The method of claim 18, wherein rotating the threaded member in a second direction to advance an end portion of the threaded member out of the hole and into contact with the first surface of the head portion comprises rotating the threaded member in the second direction to advance the end portion of the threaded member into a recess in the head portion.

20. The method of claim 18, further comprising:

inserting a tool through an opening formed in the head portion and into engagement with a keyed recess in the threaded member, after inserting the head portion of the lever onto the end of the cylinder; and rotating the tool in the second direction while the tool engages the keyed recess.

* * * * *